US009211580B2

(12) United States Patent
Rudman et al.

(10) Patent No.: US 9,211,580 B2
(45) Date of Patent: Dec. 15, 2015

(54) METHOD AND A PRESS TOOL FOR MANUFACTURING A SEPARATION DISK

(75) Inventors: Lars Johan Rudman, Farsta (SE); Sven Olov Olsson, Huddinge (SE)

(73) Assignee: Alfa Laval Corporate AB, Lund (SE)

( * ) Notice: Subject to any disclaimer, the term of this patent is extended or adjusted under 35 U.S.C. 154(b) by 1229 days.

(21) Appl. No.: 13/121,431

(22) PCT Filed: Sep. 30, 2009

(86) PCT No.: PCT/SE2009/051085
§ 371 (c)(1),
(2), (4) Date: May 26, 2011

(87) PCT Pub. No.: WO2010/039097
PCT Pub. Date: Apr. 8, 2010

(65) Prior Publication Data

US 2011/0226033 A1 Sep. 22, 2011

(30) Foreign Application Priority Data

Sep. 30, 2008 (SE) ..... 0802060

(51) Int. Cl.

| | |
|---|---|
| ***B21D 22/20*** | (2006.01) |
| ***B21D 22/02*** | (2006.01) |
| ***B21D 26/021*** | (2011.01) |
| ***B21D 53/26*** | (2006.01) |

(Continued)

(52) U.S. Cl.
CPC ..... *B21D 22/20* (2013.01); *B21D 22/02* (2013.01); *B21D 26/021* (2013.01); *B21D 53/264* (2013.01); *B04B 7/14* (2013.01); *B21D 26/031* (2013.01)

(58) Field of Classification Search
USPC ..... 72/347, 352, 356, 358, 361, 375, 379.2, 72/379.6, 385, 386, 414, 463, 467, 469, 72/470, 54, 56, 57, 60
See application file for complete search history.

(56) References Cited

U.S. PATENT DOCUMENTS

| | | | | |
|---|---|---|---|---|
| 694,736 | A * | 3/1902 | Gales | 494/73 |
| 1,006,622 | A | 10/1911 | Bailey | |
| 1,919,287 | A * | 7/1933 | Auble | 72/349 |

(Continued)

FOREIGN PATENT DOCUMENTS

| | | | |
|---|---|---|---|
| EP | 1136149 | A2 | 9/2001 |
| WO | 2007055630 | A1 | 5/2007 |

OTHER PUBLICATIONS

International Search Report, International Application No. PCT/SE2009/051085, Date Mailed Apr. 12, 2009.

*Primary Examiner* — Shelley Self
*Assistant Examiner* — Pradeep C Battula
(74) *Attorney, Agent, or Firm* — MKG, LLC

(57) ABSTRACT

The invention refers to a method and a press tool for manufacturing of a separating disk adapted to be included in a disk package of a centrifugal separator. The separating disk extends around an axis of rotation and has tapering shape with an inner surface and an outer surface along the axis of rotation. The separating disk is manufactured of a material and comprises a number of distance members in form of pressed protrusions extending away from the inner surface and/or outer surface. A blank of the material is pressed against the first tool part having a shape corresponding to the tapering shape of the pressed separating disk and comprises first form elements having a shape corresponding to the protrusions.

10 Claims, 12 Drawing Sheets

(51) Int. Cl.
*B04B 7/14* (2006.01)
*B21D 26/031* (2011.01)

(56) References Cited

U.S. PATENT DOCUMENTS 2,028,955 A * 1/1936 Shenstone ..... 494/70
5,755,129 A * 5/1998 Yamasaki ..... 72/57
5,974,847 A * 11/1999 Saunders et al. ..... 72/57
6,513,359 B1 * 2/2003 Binder et al. ..... 72/57
8,549,890 B2 * 10/2013 Klintenstedt et al. ..... 72/329
8,678,989 B2 * 3/2014 Rudman et al. ..... 494/73
2004/0083784 A1 5/2004 Kim et al.
2008/0184763 A1 8/2008 Schroth et al.

* cited by examiner

METHOD AND A PRESS TOOL FOR MANUFACTURING A SEPARATION DISK

FIELD OF THE INVENTION

The present invention refers to a method for manufacturing a separating disk adapted to be included in a disk package of a centrifuge rotor of a centrifugal separator. The invention also refers to a press tool for manufacturing a separating disk adapted to be included in a disk package for a centrifuge rotor of a centrifugal.

BACKGROUND

Today separating disks for disk packages in centrifuge rotors are normally manufactured through pressure turning of plane disks to a desired tapering shape, for instance a conical shape. This method of manufacturing has the disadvantage that the manufacturing is expensive and time-consuming. Each separating disk has to be pressure turned individually in a pressure lathe. Another disadvantage of the pressure turning method is that it is difficult to produce irregular shapes such as protrusions in the pressure turned disk. A further disadvantage of the pressure turning method is the difficulty to achieve a sufficient surface smoothness without subsequent treatment of the surface. A poor surface smoothness can lead to deteriorated hygienic properties.

SUMMARY OF THE INVENTION

One object of the present invention is to provide a method and a tool for the manufacture of a separating disk, which has a high and uniform quality and which can be manufactured at a low cost.

The present invention resides in one aspect in a method wherein apress step comprises a first part step, where the blank by means of a second tool part is pressed in a direction towards the first tool part, and a second part step, where a liquid is supplied at a pressure between a blank and the second tool part in such a way that the blank is pressed to abutment against the first tool part.

By such a press step, a separating disk may be manufactured in an easy and efficient manner. The shape and the distance members in the form of protrusions of the separating disk may be provided in the same press operation. The manufacturing cost for each separating disk may be significantly lower than for the previously used pressure turning method.

The second press step, which relies on a hydroforming principal, permits an advantageous forming of the material so that this in a uniform way is distributed to abutment against the first tool part comprising form elements for the formation of said protrusions.

According to an aspect of the method, the second part step comprises evacuation of gas present between the blank and the first tool part. In such a way a tight abutment against the first tool part is ensured.

According to a further development of the method, the press step comprises forming of at least a centering member of the pressed blank for enabling later centering of the blank. Advantageously, said centering members may be provided in a central area of the blank. Said centering members may also be provided in an edge area of the blank.

According to a further aspect of the method, there is at least a subsequent processing step for forming of an inner edge, which delimits a central opening of the separating disk, and an outer edge. The processing step may be preceded by a centering of the separating disk by means of said centering members in a processing machine before the processing step is performed. The processing step may also comprise forming of one or more than one recess along the inner edge and/or forming of one or more than one recess along the outer edge. Said recesses may be configured to permit polar-positioning of the separating disk in the disk package.

The present invention also resides in a press tool having a supply device arranged to permit in one position supply of a liquid at a pressure between the blank and the second tool part in such a way that the blank is pressed into abutment against the first tool part.

By means of such a press tool, separating disks may be manufactured through pressing in an easy and efficient manner. Furthermore, the blank may be pressed in an even and uniform manner to a final position against the first tool part.

According to an embodiment of the invention, the first tool part comprises evacuating passages for evacuation of gas present between the blank and the first tool part. By means of such evacuating passages a tight abutment against the first tool part is ensured.

According to a further embodiment of the invention, the first tool part comprises at least a second form element for forming of a centering member of the pressed blank for enabling later centering of the blank.

According to a further embodiment of the invention, the first tool part has a concave shape against which the outer surface of the separating disk abuts.

BRIEF DESCRIPTION OF THE DRAWINGS

The invention is now to be explained through a description of various embodiments and with reference to the drawings attached hereto.

DETAILED DESCRIPTION

Figure 1:
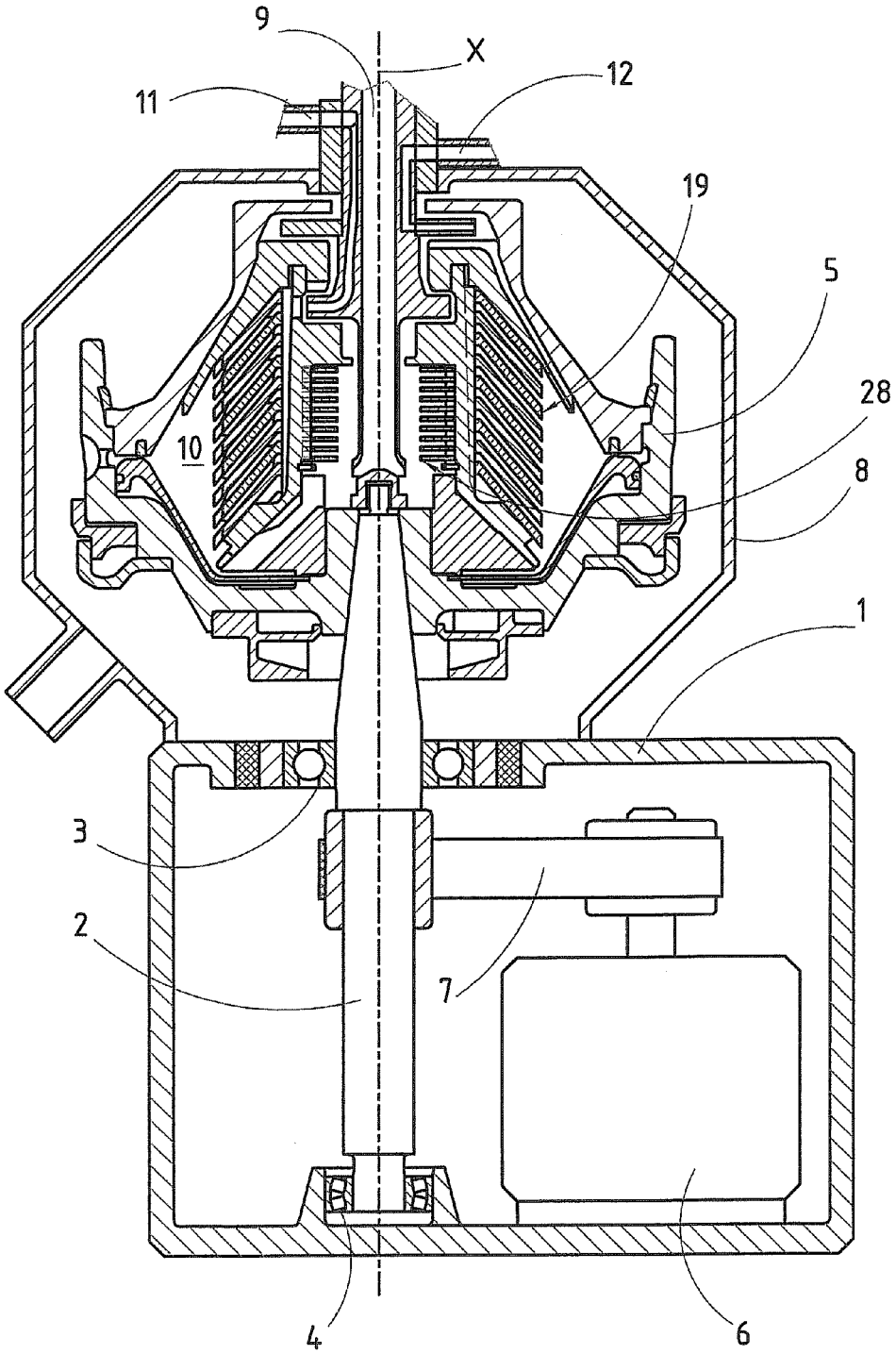
FIG. 1 discloses a partly sectional side view of a centrifugal separator with a centrifuge rotor.

FIG. 1 discloses a centrifugal separator which is adapted for separation of at least a first component and a second component of a supplied medium. It is to be noted that the disclosed centrifugal separator is disclosed as an example and that the configuration thereof may be varied. The centrifugal separator comprises a frame 1, which may be non-rotatable or stationary, and a spindle 2 which is rotably journalled in an upper bearing 3 and a lower bearing 4. The spindle 2 carries a centrifuge rotor 5 and is arranged to rotate together with the centrifuge rotor 5 around an axis x of rotation in relation to the frame 1. The spindle 2 is driven by means of a drive member 6 which is connected to the spindle 2 in a suitable manner in order to rotate the latter at a high velocity, for instance via a drive belt 7 or a gear transmission, or through direct drive, i.e. the rotor (not disclosed) of the drive member 6 is directly connected to the spindle 2 or the centrifuge rotor 5. It is to be noted here that elements having the same function has been provided with identical reference signs in the various embodiments to be described.

The centrifugal separator may comprise a casing 8 which is connected to the frame 1 and which encloses the centrifuge rotor 5. Furthermore, the centrifugal separator comprises at least one inlet 9, which extends through the casing 8 and into a separation space 10 which is formed by the centrifuge rotor 5 for feeding of the medium to be centrifuged, and at least a first outlet for discharge from the separation space 10 of the first component which has been separated from the medium and a second outlet for discharge from the separation space 10 of the second component which has been separated from the medium.

In the separation space 10, there is a disk package 19 which rotates with the centrifuge rotor 5. The disk package 19 comprises or is assembled of a plurality of separating disks 20 which are stacked onto each other in the disk package 19, see FIG. 2. A separating disk 20 according to a first embodiment is disclosed more closely in FIGS. 3 and 4. Each separating disk 20 extends around the axis x of rotation and rotates around the axis x of rotation in a direction R of rotation. Each separating disk 20 extends along a rotary symmetric, or virtually rotary symmetric, surface which tapers along the axis x of rotation, and has a tapering shape along the axis x of rotation with an outer surface 21, which is convex, and an inner surface 22, which is concave. The tapering shape of the separating disks 20 may also be conical or substantially conical, but it is also possible to let the tapering shape of the separating disks 20 have a generatrix which is curved inwardly or outwardly. The separating disks 20 thus have an angle $\alpha$ of inclination in relation to the axis x of rotation, see FIG. 2. The angle $\alpha$ of inclination may be 20-70°. Each separating disk 20 also has an outer edge 23 along the radially outer periphery of the separating disk 20 and an inner edge 24 which extends along the radially inner periphery of the separating disk 20 and defines a central opening of the separating disk 20.

Figure 5:
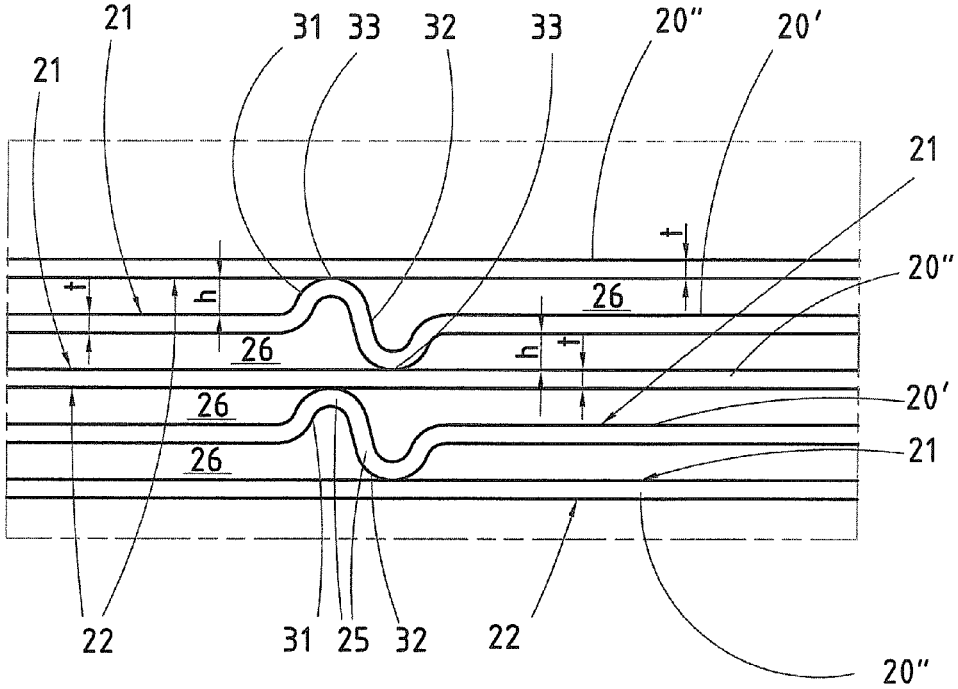
FIG. 5 discloses a section through the disk package in FIG. 2.

Between the separating disks 20, there are distance members 25 which are provided on the outer surface 21 and/or the inner surface 22 and arranged to ensure the formation of an interspace 26 between adjacent separating disks 20 in the disk package 19, see FIG. 5. Each separating disk 20 comprises at least one portion without distance members 25 on the outer surface 21 and/or the inner surface 22. The separating disks 20 may be provided around a so called distributor 27. The separating disks 20 are compressed against each other in the disk package 19 with a pre-tensioning force in such a way that the distance members 25 of a separating disk abuts sealingly an adjacent separating disk 20, against the above-mentioned portion of an adjacent separating disk 20. The separating disks 20 may also be fixedly connected to each other, for instance through brazing.

Figure 2:
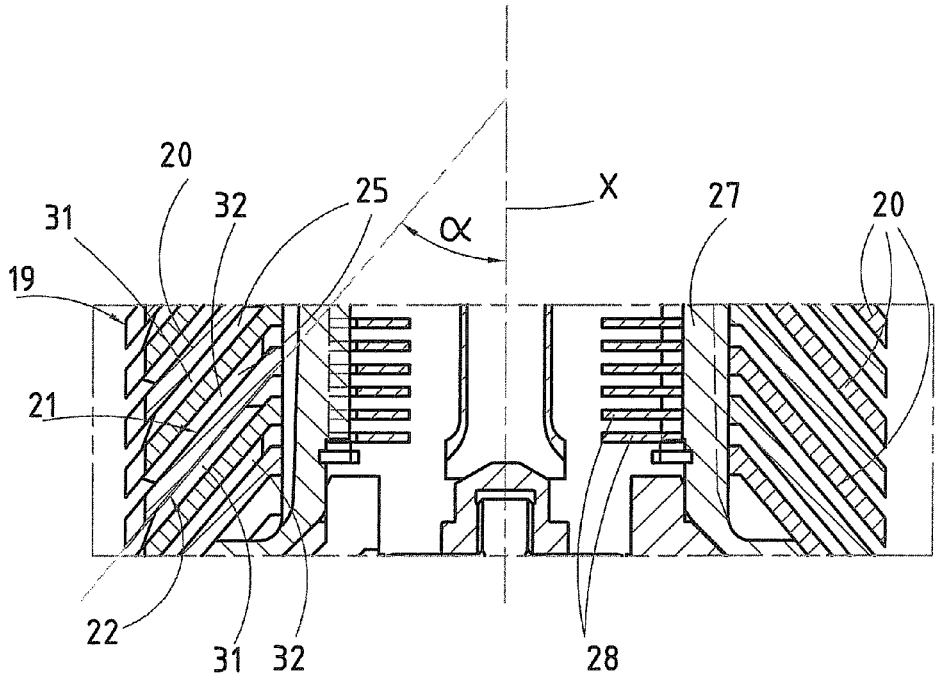
FIG. 2 discloses a sectional side view through a disk package of the centrifugal separator in FIG. 1.

As can be seen in FIGS. 1 and 2, the centrifuge rotor 5 also comprises a number of inlet disks 28 which are centrally provided in the distributor 27. These inlet disks 28 may be manufactured in a similar manner as the separating disks 20. The inlet disks 28 may be plane, as disclosed in FIGS. 1 and 2, or conical. The inlet disks 28 may have distance members with a similar configuration as the distance members 25 of the separating disks 20.

The tapering shape of the separating disks 20 has been provided through pressing a blank of material against a tool part. The material may be any pressable material, for instance metal material, such as, but not limited to, steel, aluminium, titanium, various alloys etc., and also suitable plastic materials. The tool part to be described in greater detail below has a shape corresponding to the tapering shape of the pressed separating disk 20. It is to be noted, however, that the separating disks 20 as a consequence of such a pressing may obtain a thickness t that varies with the distance from the axis x of rotation.

Figure 4:
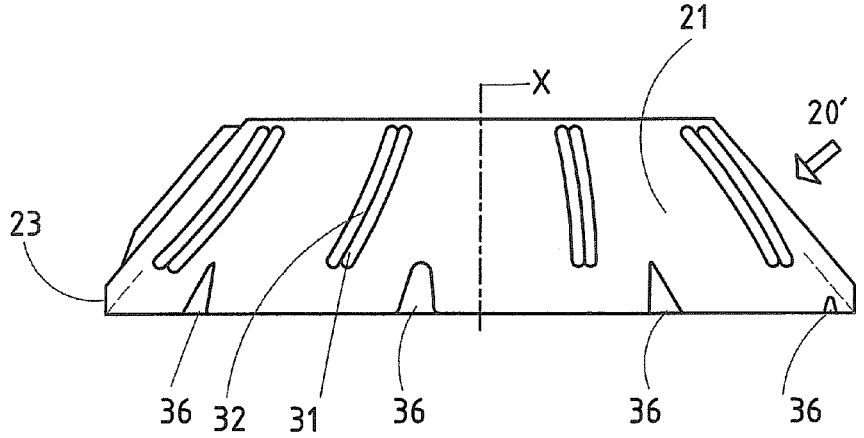
FIG. 4 discloses a side view of the separating disk in FIG. 3.
Figure 3:
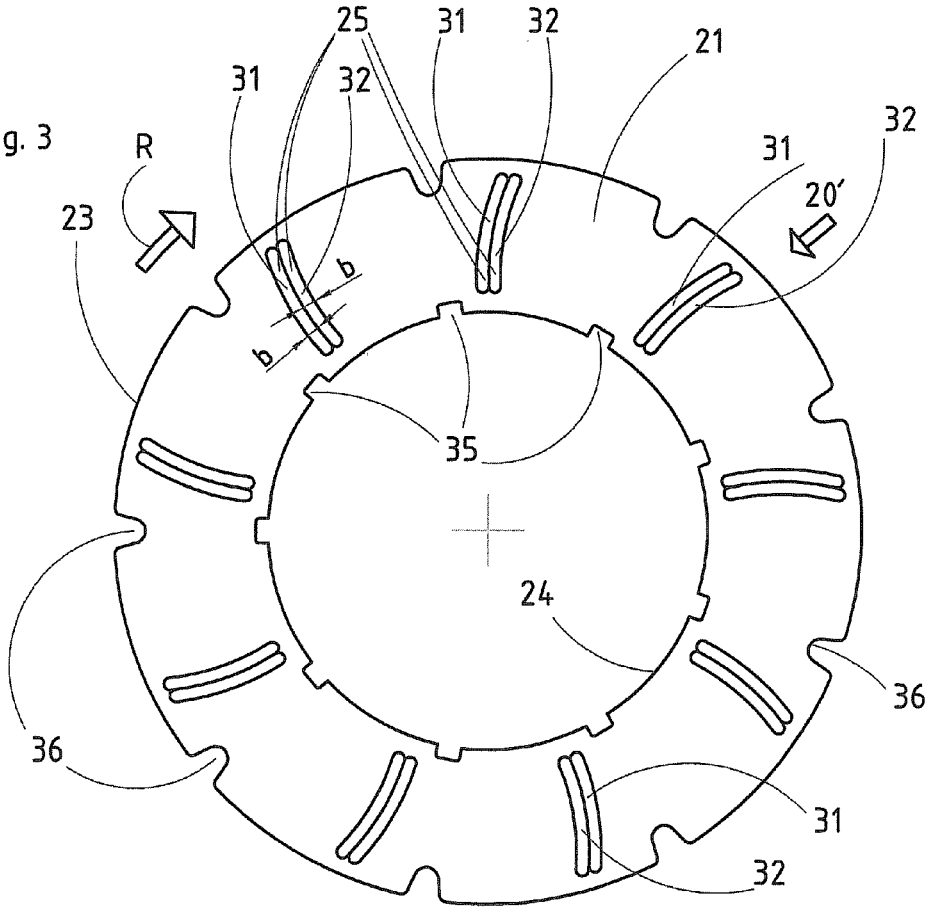
FIG. 3 discloses a view from above of a separating disk of the disk package according to a first embodiment.

As shown in the embodiment of FIGS. 3-5, the distance members 25 are formed as protrusions in the material, wherein the tapering shape and the protrusions of the separating disk 20 have been produced through pressing of the blank against the tool part having a shape corresponding to the tapering shape with the protrusions of the pressed separating disk 20. In the first embodiment the distance members 25 comprise first distance members 25 in the form of first protrusions 31 and second distance members 25 in the form of second protrusions 32. The protrusions thus comprise a number of pairs of protrusions, wherein each of the pairs comprises a first protrusion 31 extending away from the outer surface 21 and a second protrusion 32 extending away from the inner surface 22. The first and second protrusions 31, 32 are displaced in relation to each other seen in a normal direction with regard to the outer surface 21. In the embodiment disclosed, the first and second protrusions 31, 32 are provided adjacent, or directly adjacent, to each other in a peripheral direction of the separating disk 20. It is possible to provide the distance members 25, i.e. in the embodiments disclosed the first and second protrusions 31, 32 in each pair at a significant distance from each other, for instance in such a way that a first protrusion 31 is located at the center between two second protrusions 32. Possibly, the protrusions 31, 32, may then be given wider shape and in onecase could extend substantially straight from the peak of a first protrusion 31 to the peak of the adjacent second protrusions 32, which means that there is no marked beginning or marked end of the distance members 25.

As can be seen in FIG. 5, the first protrusion 31 abuts the inner surface 22 of the adjacent separating disk 20, whereas the second protrusion 32 abuts the outer surface 21 of an adjacent separating disk 20. The first protrusion 31 will thus form a channel-like depression of the inner surface 22 and this depression is configured to collect and transport one of said components radially outwardly or inwardly on the inner surface 22. The second protrusion 32 forms, in a corresponding manner, a channel-like depression of the outer surface 21, wherein this depression is configured to collect and transport one of said components radially outwardly or inwardly on the outer surface 21. In the first embodiment, the second protrusion 32 is located after the first protrusion 31 with regard to the direction R of rotation. With regard to the outer surface 21, the channel-like depression thus precedes the upwardly projecting first protrusion 31. With regard to the inner surface 22, the channel-like depression instead follows the downwardly projecting second protrusion 32. Inverted relations arise if the direction of rotation is the opposite.

The first and second protrusions 31 and 32 have a height h above the outer surface 21 and the inner surface 22, respectively, see FIG. 5. This height h determines also the height of the interspaces 26 between the separating disks 20 in the disk package 19. Since the thickness t of the separating disks 20 may vary with the distance from the axis x of rotation, the first and second protrusions 31 and 32 may advantageously be configured in such a way that the height h varies with the distance from the axis x of rotation. As can be seen in FIG. 3, the distance members 25, i.e. the first and second protrusions 31 and 32, have an extension from a radially inner position to a radially outer position, wherein the height h varies along this extension in such a way that this varying height compensates for the varying thickness. In such a way a tight and uniform abutment between the first and second protrusions 31 and 32 against the inner surface 22 and the outer surface 21, respectively, can be ensured along the whole or substantially the whole extension of the protrusions 31, 32.

Depending on the actual press method, the thickness t of the separating disk 20 may increase with an increasing distance from the axis of rotation, wherein the height h decreases with an increasing distance from the axis x of rotation. The thickness t of the separating disk 20 may also decrease with an increasing distance from the axis x of rotation, wherein the height of the distance members 25 increases with an increasing distance from the axis x of rotation. It is to be noted that the varying height h can be provided in an advantageous manner since the separating disks 20 are manufactured in a press method and pressed against a tool part with a corresponding shape. The tool part can thus have projections and depressions, respectively, which are configured for the formation of the protrusions, and which have been given a varying height h in accordance with the applied press method in connection with the tool manufacturing.

The press method also makes it possible in an easy manner to let the extension of the protrusions 31, 32 be straight and radial or substantially radial, straight but inclined in relation to a radial direction, or curved at least if the protrusions 31, 32 are seen in the direction of the axis x of rotation. In the first embodiment the extension of the protrusions 31, 32 extends from in the proximity of the inner edge 24 to in the proximity of the outer edge 23.

The press method also makes it possible to configure the distance members 25, i.e. the first and second protrusions 31, 32, with a width at the inner surface and/or the outer surface 21 seen in a normal direction to the inner surface or the outer surface 21, wherein this width of at least some of the distance members 25 varies with the distance from the axis x of rotation.

Furthermore, the press method also enables the formation of stiffening folds or embossings (not shown) of the separating disks 20. Such folds may be straight or curved or extend in suitable directions.

Each of the first and second protrusions 31 and 32 comprises at least one contact zone 33 intended to abut the inner surface 22 and the outer surface 21, respectively, of an adjacent separating disk 20 in the disk package 19. As can be seen in FIG. 5, the contact zone 33 has a continuously convex shape seen in cross section, in the first embodiment in a cross section transversally to a substantially radial direction. In the first embodiment, the contact zone 33 extends along the whole, or substantially the whole, extension of the first and second protrusions 31 and 32. With such a continuously convex shape of the contact zone 33, a small contact area between the contact zone 33 and the adjacent separating disk 20 is ensured, i.e. the contact area approaches zero. The contact zone 33 may, in the first embodiment, be defined to form a line abutment, or substantially a line abutment, against the inner surface 22 and the outer surface 21 respectively, of the adjacent separating disk 20 along the whole extension of the protrusions 31 and 32.

As can be seen in FIGS. 2 and 5, the separating disks 20 comprise first separating disk 20' and second separating disks 20". The first separating disks 20' comprise the first and second protrusions 31 and 32 which have been described above. The second separating disks 20" lack such protrusions, i.e. they comprise, or consist of, only one of the above mentioned portion without distance members 25. The second separating disks 20" thus have an even, or substantially even, tapering shape. The first and second separating disks 20' and 20" are provided in an alternating order in the disk package 19, i.e. every second separating disk 20 is a first separating disk 20' and every second separating disk is a second separating disk 20".

As can be seen in FIG. 3, each separating disk 20 comprises one or recess 35 along the inner edge 24. Such recesses may have the purpose of enabling a polar-positioning of the separating disks 20 in the disk package 19. Furthermore, each separating disk 20 comprises one or more than one recess 36 along the outer edge 23. The recesses 36 may have the purpose of permitting transport of the medium through the disk package 19 and feeding of the medium into the different interspaces 26. It is to be noted that the recesses 35 and 36 may be advantageous for reducing the inherent stresses in the material in the pressed separating disk 20. The recesses 36 may be replaced by holes which in a manner known per se extend through the separating disk 20 and are provided at a distance from the inner and the outer edges 24, 23.

The separating disks 20 are polar-positioned in such a way that the first protrusions 31 of the first separating disks 20' are in line with each other in the disk package 19 seen in the direction of the axis x of rotation, see FIG. 5. Such a configuration of the disk package 19 is advantageous since it makes it possible to include a pre-tensioning in the disk package 19 when it is mounted. The second separating disks 20" will during the compressing of the disk package 19 be deformed elastically alternately upwardly and downwardly by the first and second protrusions 31 and 32 of the adjacent separating disks 20'. During operation of the centrifugal separator, forces arise in the second separating disks 20", which forces strive to straighten out the elastic deformation. Consequently, the abutment force between the separating disks 20 in the disk package 19 increases. In the embodiment disclosed, the first and second separating disks 20' and 20" have the same thickness t. However, it is to be noted that the first and second separating disks 20' and 20" may have different thicknesses t. Especially, the second separating disks 20", which lack protrusions, may have a thickness t which is smaller than the thickness t of the first separating disks 20'. It is also to be noted that the height h of each distance member 25 of a first separating disk 20' varies in such a way that it compensates for the varying thickness t of the first separating disk 20' and for the varying thickness t of an adjacent second separating disk 20".

Figure 6:
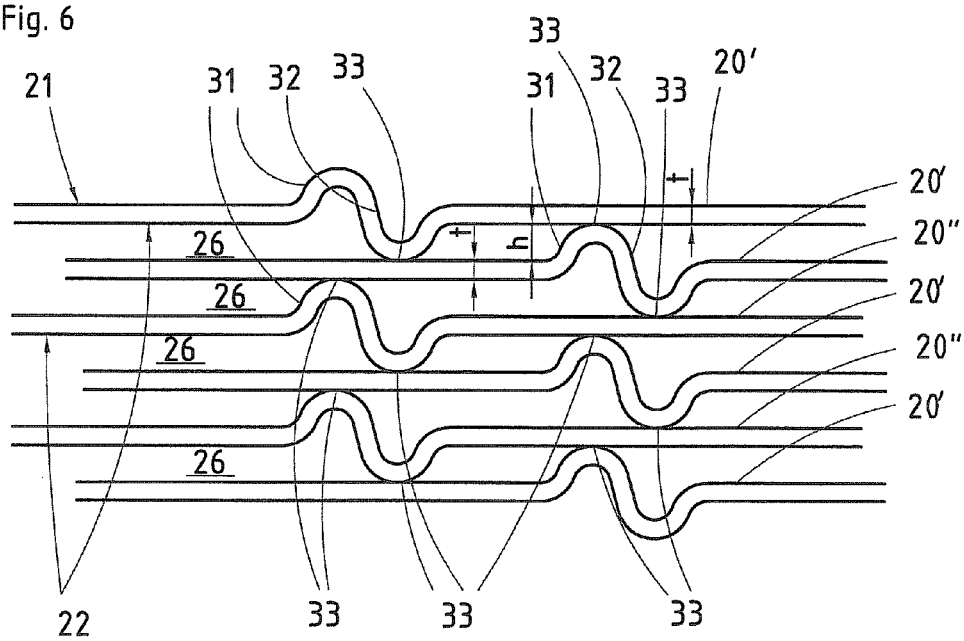
FIG. 6 discloses a section similar to the one in FIG. 5 of a part of a disk package according to a second embodiment.

According to a second embodiment of the disk package 19, see FIG. 6, also each second separating disk 20" may comprise a number of distance members in the form of pressed first and second protrusions 31 and 32, i.e. all separating disks 20 are provided with first and second protrusions 31 and 32. In this case, the separating disks 20 may be polar-positioned in such a way that first protrusions 31 of the first separating disks 20' are displaced in relation to the first protrusions 31 of the second separating disks 20" in the disk package 19 seen in the direction of the axis x of rotation.

According to a variant of the invention, the second separating disks 20 or the portions without distance members of the separating disks 20 may be provided with plastically deformed portions where the contact zone 33 of a first and/or second protrusion 31, 32 abuts or is intended to abut. The height of these plastically deformed portions is significantly lower than the height of the first and second protrusions 31, 32. In such a way a secure positioning of the separating disks 20 in relation to each other is created.

Figure 7:
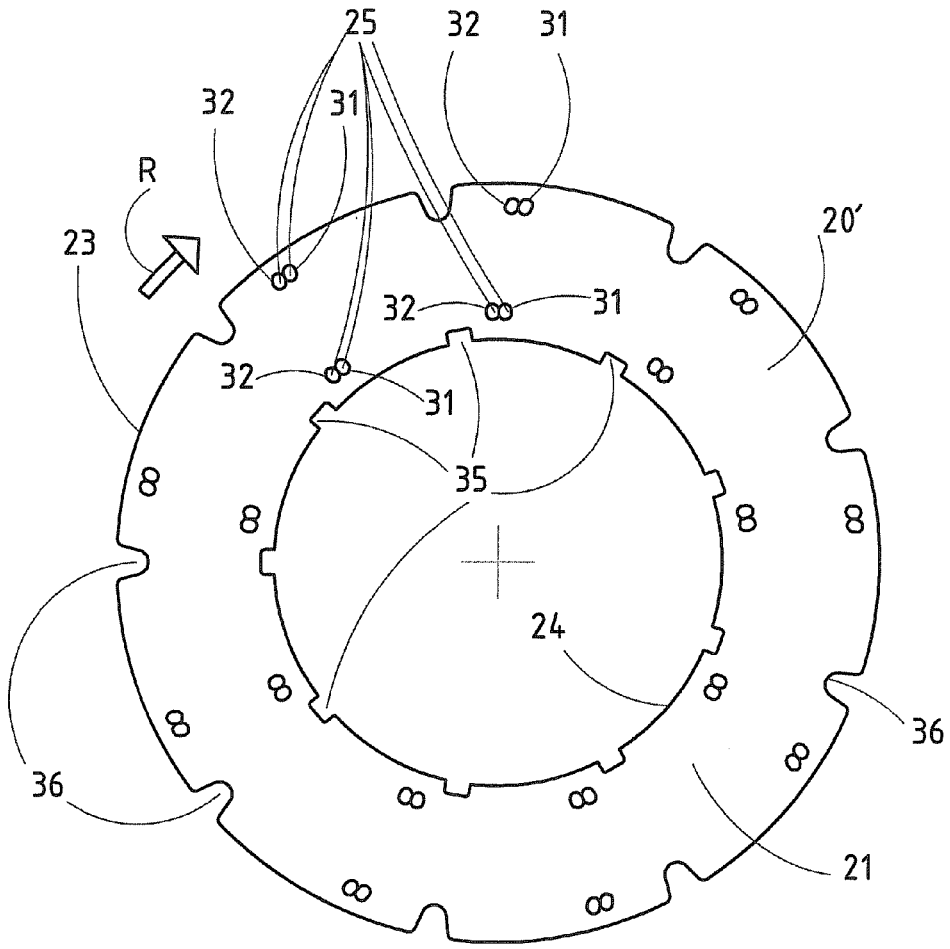
FIG. 7 discloses a view similar to the one in FIG. 3 of a separating disk according to a third embodiment.

FIG. 7 discloses a third embodiment where the distance members 25 have a spot-like extension. Also in this embodiment, the height of the distance members 25 may vary with the distance of the spot-like distance members 25 from the axis x of rotation. These distance members 25 may advantageously also be configured as first protrusions 31 extending away from the outer surface 21 and second protrusions 32 extending away from the inner surface 22. Each protrusion 31, 32 may advantageously have a continuously convex shape seen in a section transversally to a peripheral direction and transversally to a radial direction. In this embodiment, the contact zone 33 may be defined to form a point abutment, or substantially a point abutment, against the inner surface 22 or the outer surface 21 of the adjacent separating disk 20. The protrusions 31 and 32 are displaced in relation to each other and may be provided at a distance from or adjacent to each other. Moreover, it is to mentioned here that the separating disks 20 according to a further alternative may comprise both spot-like distance members 25 and elongated distance members 25.

Figure 8:
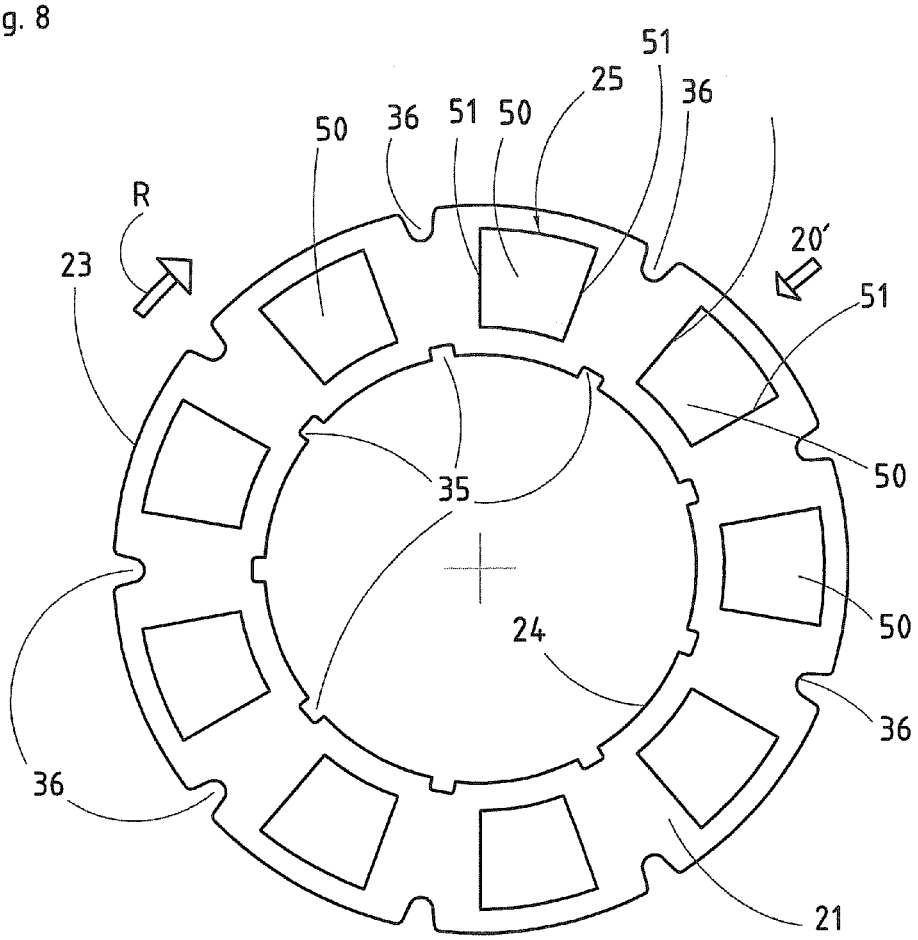
FIG. 8 discloses a view similar to the one in FIG. 3 of a separating disk according to a forth embodiment.
Figure 9:
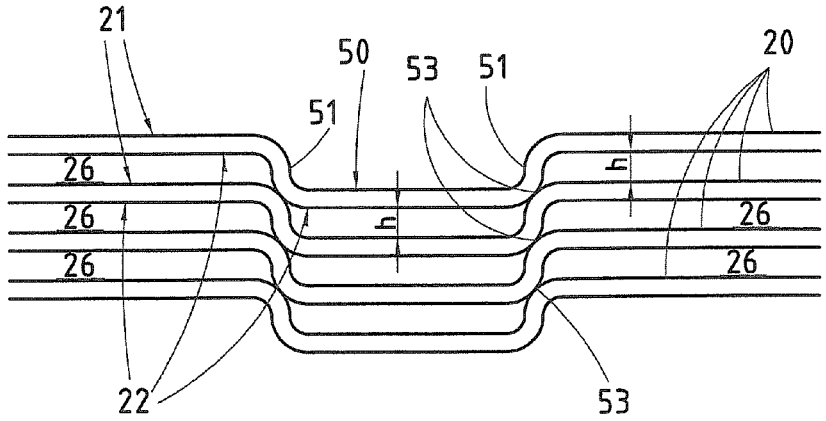
FIG. 9 discloses a section similar to the one in FIG. 5 through a disk package with separating disks according to the forth embodiment.

FIGS. 8 and 9 disclose a fourth embodiment of a pressed separating disk 20, where the distance members 25 are formed by protrusions 50 which all extends in the same direction away from the outer surface 21. Each protrusion 50 is delimited by two opposite side lines 51, which extend towards the outer edge 23 of the separating disk 20. In this embodiment, all separating disks 20, or substantially all separating disks 20, are identical. FIG. 9 discloses how the separating disks 20 are polar-positioned and abuts each other. In an area around each of the side lines 51, the protrusions 50 comprise a contact zone 53 on the outer surface 21 and a contact zone 53 on the inner surface 22. In the disk package 19, the contact zone 53 of a separating disk 20 abuts the contact zone 53 of an adjacent separating disk 20. Also here, each contact zone 53 has continuously convex shape seen in a cross section transversally to a substantially radial direction. The contact zones 53 extend along the whole, or substantially the whole, extension of the protrusions 50, and can be defined to form a line abutment, or substantially a line abutment, between the separating disks 20.

In the fourth embodiment, the protrusions 50 have substantially the same width as the areas between the protrusions 50. It is to be noted, however, that the width of the protrusions 50 also could be larger or smaller than the width of these areas. As can be seen FIG. 8, the protrusions 50 extend radially, or substantially radially from in the proximity of the inner edge 24 to in proximity of the outer edge 23. It is possible to let the protrusions 50 slope in relation to a radial direction and/or extend all the way to the inner edge 24 and/or all the way to the outer edge 23. Also according to the forth embodiment, it is possible to let the height of the protrusions 50 vary in order to compensates for a varying thickness of the pressed separating disk 20.

Figure 10:
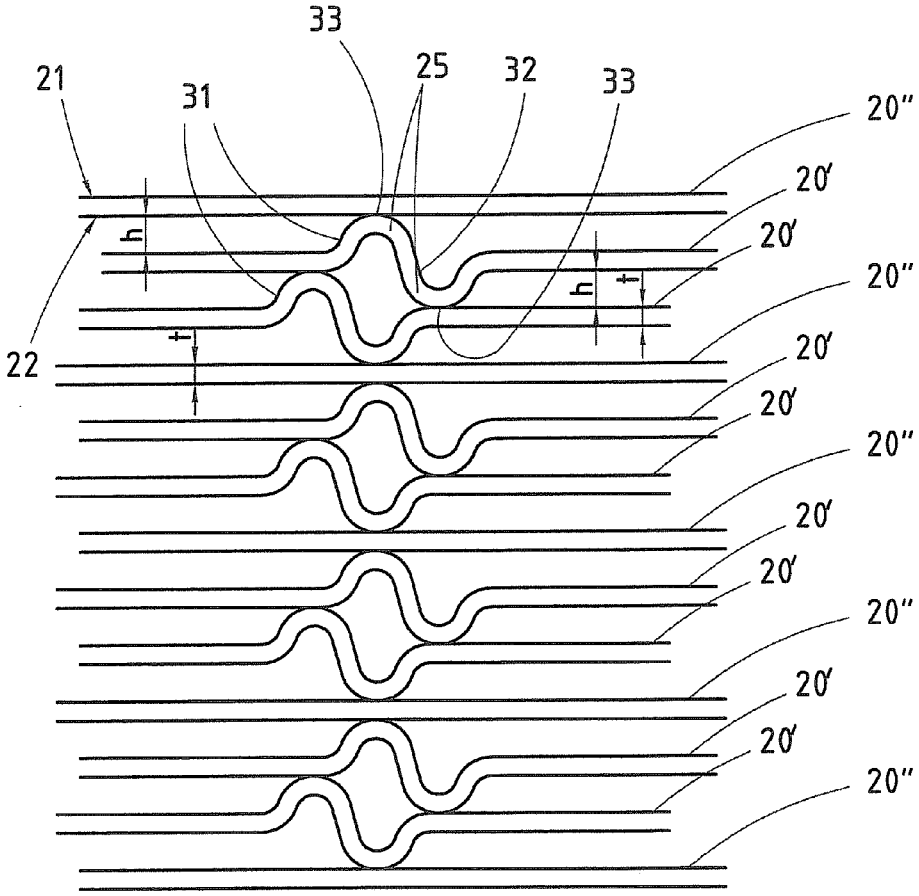
FIG. 10 discloses a section similar to the one in FIG. 5 through a disk package with separating disks according to a fifth embodiment.

It is to be understood that the polar-positioning of the separating disks 20 may be varied in many different ways in addition to the ways disclosed in FIGS. 5 and 6. FIG. 10 discloses a fifth embodiment where two first separating disks 20' are provided beside each other and each such pair of first separating disks 20' are separated by a second separating disk 20". The first protrusion 31 of a first separating disk 20' in such a pair lies opposite to the second protrusion 32 of the second first separating disk 20' in this pair, and opposite the first protrusions 31 of corresponding disks 20' in the remaining pairs.

Figure 11:
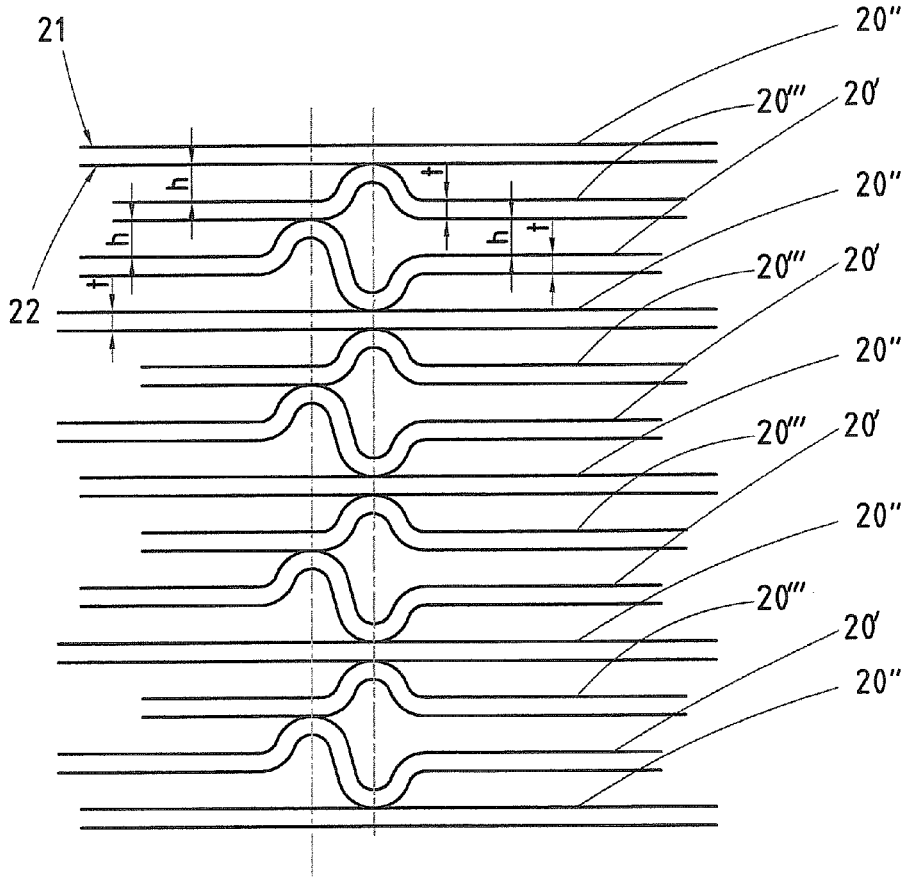
FIG. 11 discloses a section similar to the one in FIG. 5 through a disk package with separating disks according to a sixth embodiment.
Figure 12:
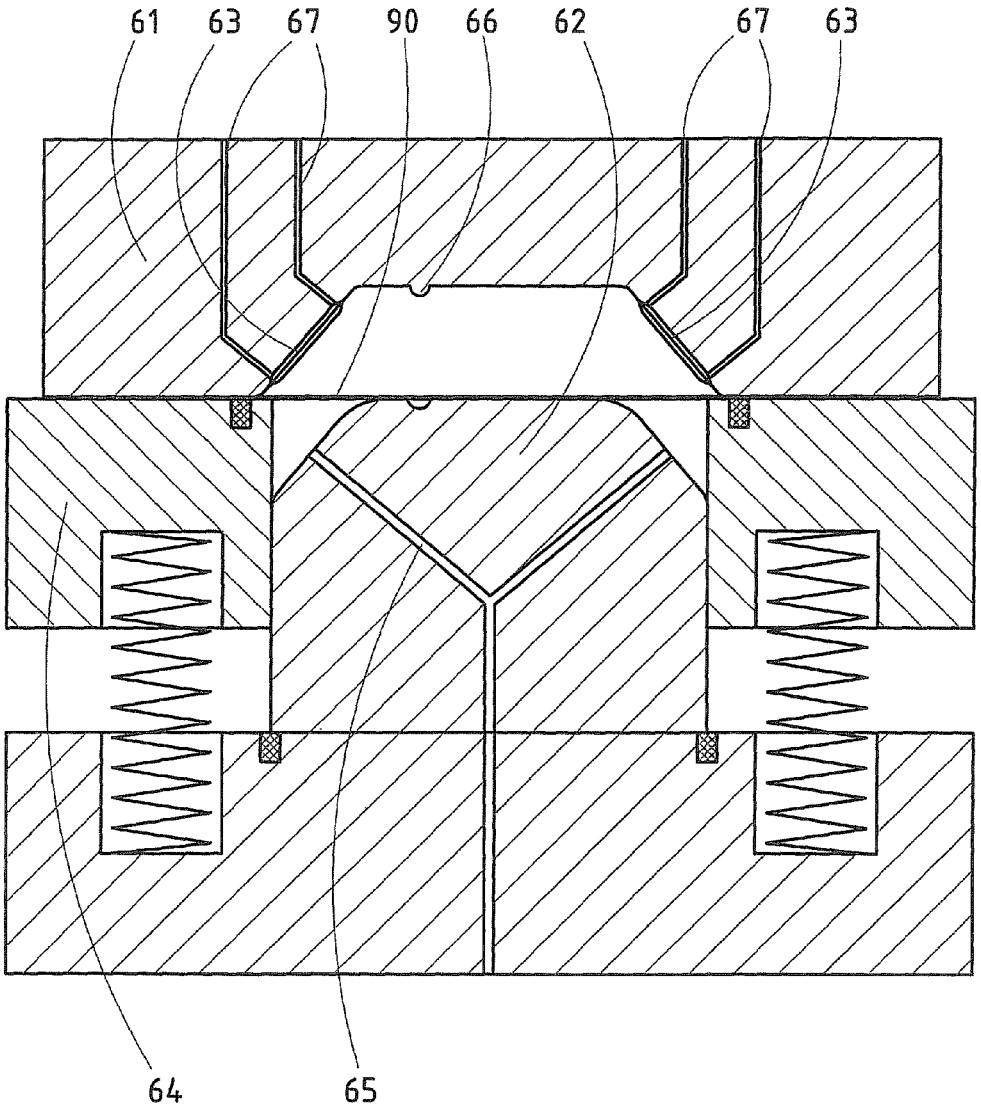
FIG. 12-14 discloses a sectional view of a first variant of a press tool for pressing a separating disk.
Figure 13:
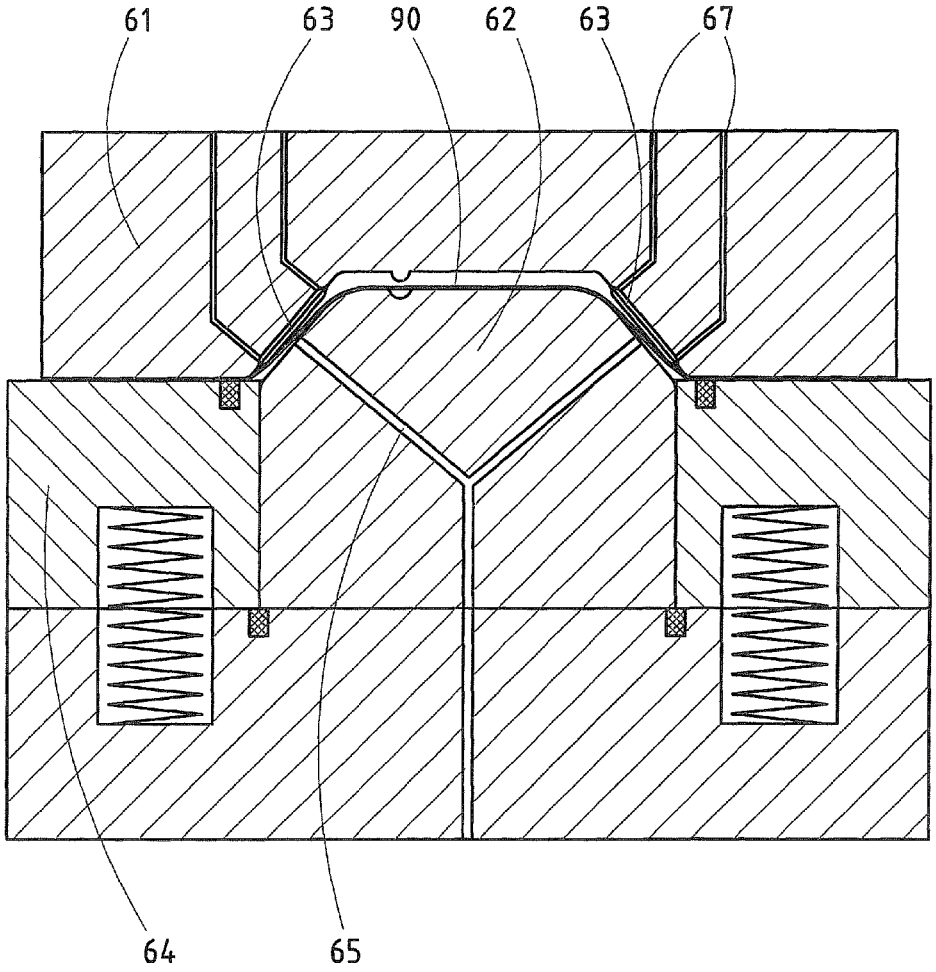
Figure 14:
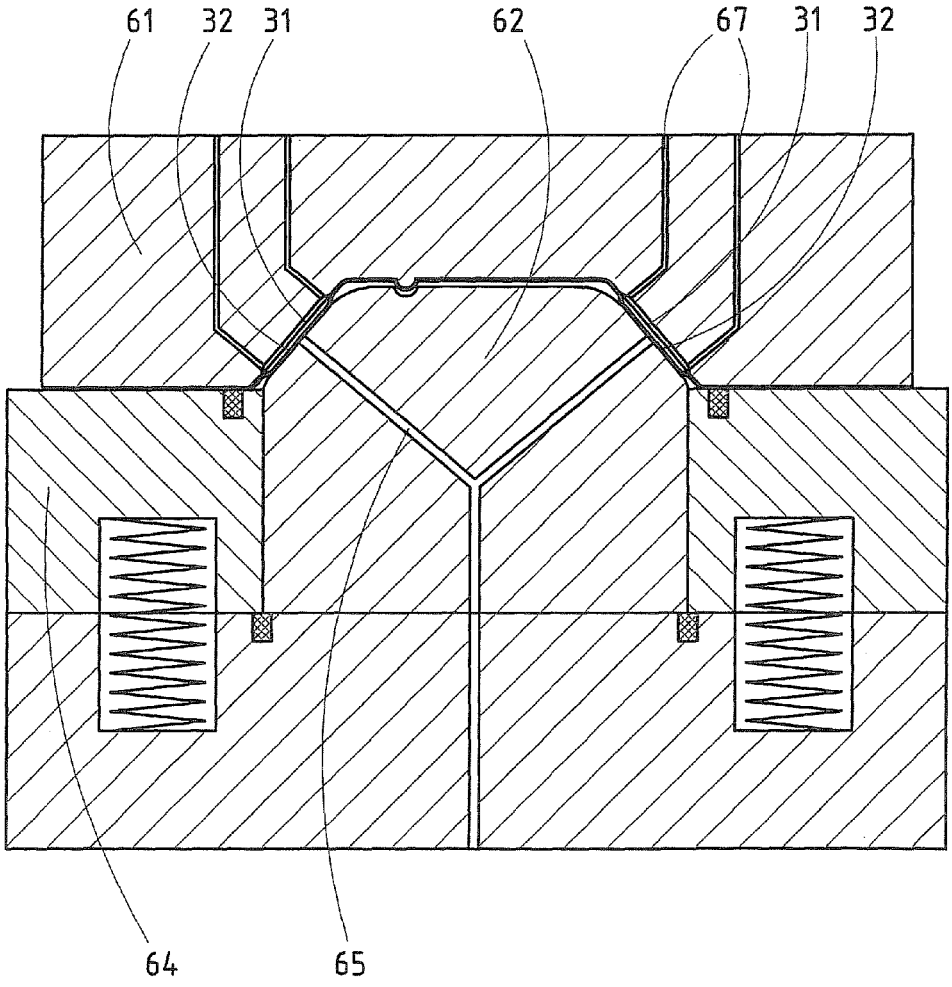

FIG. 11 discloses a sixth embodiment which is similar to the fifth embodiment, but differs from the latter since one of the first separating disks 20' has been modified and is a third separating disk 20'" which comprises a first protrusion 31 but no second protrusion 32. The first protrusion 31 of the third separating disk in each pair lies opposite to the second protrusion 32 of the first separating disk 20' in each pair. In the fifth embodiment, a space which is closed in a cross-section is formed. Thanks to the absence of the second protrusion 32 of the third separating disk 20'", a lateral opening into this space is formed. It may also be mentioned that this closed space disclosed in FIG. 10 may be open at the ends through a variation of the length of the protrusions along their extension.

FIGS. 12 to 15 disclose a first variant of a press tool for manufacturing a separating disk as defined above. The press tool is intended to be introduced into a press (not disclosed) of a suitable design. The press tool comprises a first tool part 61 and a second tool part 62. The first tool part 61 has a concave shape against which the outer surface 21 of the separating disk 20 abuts after finished pressing. The first tool part 61 has a substantially plane bottom surface and a surrounding tapering side surface, in the example disclosed a surrounding substantially conical side surface. The first tool part 61 thus have a shape corresponding to the tapering shape of the pressed separating disk 20. In the case that the separating disk 20 is provided with protrusions 31, 32, 50, the first tool part 61 also comprises first from elements 63 which are located on the surrounding tapering side surface and which correspond to the shape of these protrusions, in the disclosed press tool, the protrusions 31 and 32. The press tool comprises, or is associated with, a holding member 64, which is arranged to hold the blank 90 to be pressed against the first tool part 61 with a holding force. If the separating disk 20 lacks protrusions a first tool part 61 without first form elements 63 is used.

Furthermore, the press tool comprises a supply device arranged to permit supply of a liquid at a pressure between the blank 90 and the second tool part 62. The supply device comprises channels 65 extending through the second tool part 62 through the surface of the second tool part 62 which faces the blank 90.

Figure 15:
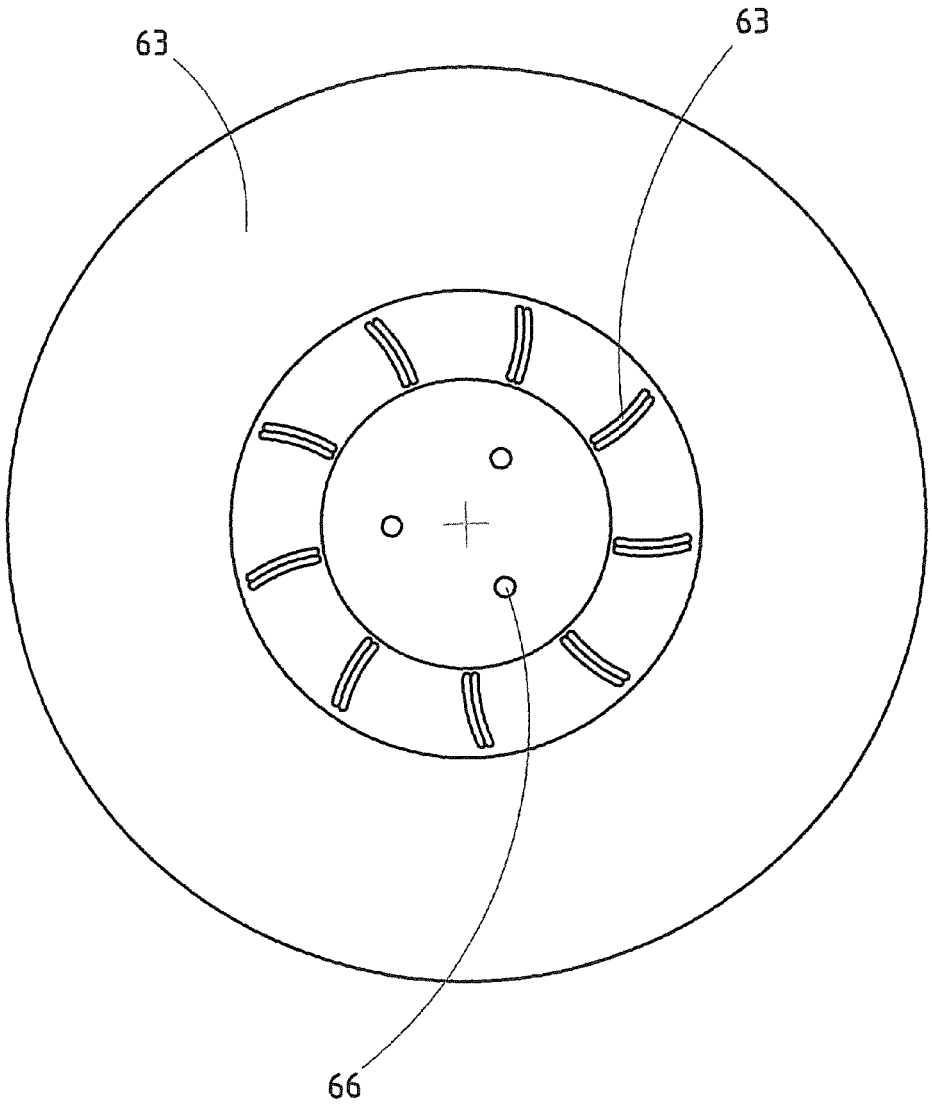
FIG. 15 discloses a plan view of a tool part of the press tool in FIGS. 12-14.

The first tool part 61 also comprises one or more than onesecond form elements 66, see FIG. 15, for forming a or several centering members of the pressed blank 90 in order to enable later centering of the blank 90 in connection with a subsequent processing of the blank 90. The form elements 66 are located on the bottom surface, which means that the centering members are provided in a central area of the blank 90. It is also imaginable to provide the centering members in an edge area of the blank 90, wherein corresponding second form elements will be located outside the tapering side surface.

Furthermore, the first tool part 61 can comprise a plurality of evacuating passages 67 for evacuation of gas present between the blank 90 and the first tool part 61. The evacuating passages 67 have a very small flow area and are provided to extend through the bottom surface and the surrounding tapering side surface of the first tool part 61. The evacuating passages 67 extend through these surfaces at the first form elements 63 forming the first and second protrusions 31 and 32, and at the second form elements 66 forming the centering member.

The press tool is arranged to permit, in a charging position, introduction of the blank 90 to be pressed between the first tool part 61 and the second tool part 62. Thereafter, the blank 90 is clamped between the first tool part 61 and the holding member 64 see FIG. 12. The first tool part 61 and/or the second tool part 62 are then displaced in a first part step in the direction towards each other to a final position, see FIG. 13. The first part step can be regarded as a mechanical press step. Thereafter, a liquid with a pressure is supplied in a second part step into a space between the blank 90 and the second tool part 62 through the channels 65 in such a way that the blank 90 is pressed to abutment against the first tool part 61 and takes its final shape, see FIG. 14. During the second part step, the gas present between the blank 90 and the first tool part 61 will be evacuated via the evacuating passages 67. The second part step can be regarded as a hydroforming step.

After the pressing, the blank 90 is removed from the press tool and transferred to any suitable processing machine (not disclosed). The blank 90 is centered in the processing machine by means of the centering member or members. The processing machine is then arranged to form, in a subsequent processing step, the inner edge 24 and the outer edge 23 of the separating disk 20.

This subsequent processing step comprises forming of the above mentioned one or several recesses 35 along the inner edge 24 and the above mentioned one or several recesses 36 along the outer edge 23. The subsequent processing step may comprise any suitable cutting or shearing operation.

It is to be noted that the first tool part 61 instead of a concave shape may have a convex shape, wherein the inner surface 22 of the separating disk 20 will abut the first tool part 61 after finished pressing.

It is to be noted that the separating disks 20 may be provided with a certain surface roughness on the outer surface and/or the inner surface. Such a surface roughness can be provided through a treatment in advance of the whole, or a part or parts of the outer surface 21 and/or the inner surface 22, for instance in that the actual surface is etched before the separating disk is pressed. The surface roughness will remain after the pressing. It is also imaginable to configure one or both tool parts 61, 62 with a surface roughness, wherein the pressing will provide the desired surface roughness of the actual surface of the outer surface and/or inner surface of the separating disk. Suitable examples of the surface roughness is disclosed in SE-B-457612. The roughness may thus comprise a plurality of flow influencing members having a certain height over the actual surface and a certain mutual distance. The relation between the certain height and the certain distance may lie in the interval 0.2-0.5. As indicated above, it is possible to provide selected parts with a roughness. Different parts of the actual surface may also have different roughness. Advantageously, only one of the outer surface 21 and the inner surface 22 is provided with a roughness. The protrusions 31, 32 suitably have no roughness as well as the surface portions against which the protrusions 31, 32 abut.

The invention is not limited to the embodiments disclosed but may be varied and modified with in the scope of the following claims. Especially, it is to be noted that the described separating disks may be used in substantially all kinds of centrifugal separators, for instance such where the centrifuge rotor has fixed openings for radial discharge of sludge, or intermittently openable such openings, see FIG. 1. The invention is applicable to centrifugal separators adapted for separation of all kinds of media, such as liquids and gases, for instance separating of solid or liquid particles from a gas.

What is claimed is:

1. A method for manufacturing a separating disk adapted to be included in a disk package of a centrifuge rotor of a centrifugal separator, wherein the separating disk extends around an axis (x) of rotation and has a tapering shape with an inner surface and an outer surface along the axis (x) of rotation, wherein the separating disk is manufactured of at least a material and wherein the separating disk comprises a number of distance members in the form of pressed protrusions extending away from at least one of the inner surface and/or the outer surface, wherein the method comprises a press step, which comprises pressing of a blank of the material against a first tool part, which has a shape corresponding to the tapering shape of the pressed separating disk and comprises first form elements having a shape corresponding to the protrusions, the press step further comprises:

a first part step, where the blank by means of a second tool part is pressed in a direction towards the first tool part, a second part step performed after the first part step, the second part step comprising supplying a pressurized liquid between the blank and the second tool part and pressing, via the pressurized liquid, the blank into abutment against the first tool part;

the pressurized liquid is provided through the second tool part; and the pressing, via the pressurized liquid, the blank into abutment against the first tool part of the second part step further comprises pressing the blank from an intermediate shape to a final shape.

2. A method according to claim 1, wherein the second part step comprises evacuation of gas present between the blank and the first tool part.

3. A method according to claim 1, wherein the press step comprises forming of at least a centering member of the pressed blank for enabling later centering of the blank.

4. A method according to claim 3, wherein said centering member are provided in a central area of the blank.

5. A method according to claim 3, wherein said centering members are provided in an edge area of the blank.

6. A method according to claim 3, wherein the method comprises at least a subsequent processing step for forming of an inner edge, which delimits a central opening of the separating disk, and an outer edge.

7. A method according to claim 6, wherein the processing step is preceded by a centering of the separating disk by means of said centering member in a processing machine before the processing step is performed.

8. A method according to claim 6, wherein the processing step comprises forming of one or several recesses along the inner edge.

9. A method according to anyone of claim 8, wherein said recess is configured to permit polar-positioning of the separating disk in the disk package.

10. A method according to claim 6, wherein the processing step comprises forming of one or several recesses along the outer edge.

* * * * *